United States Patent [19]

Yokota et al.

[11] 4,068,670

[45] Jan. 17, 1978

[54] SMOKING COMPOSITION

[75] Inventors: Hiromu Yokota; Hajime Namikoshi, both of Himeji; Masataka Watanabe, Yokohama; Kunio Kato, Yokohama; Akio Ohnishi, Yokohama, all of Japan

[73] Assignees: Daicel Ltd., Osaka; The Japan Tobacco & Salt Public Corporation, Tokyo, both of Japan

[21] Appl. No.: 630,272

[22] Filed: Nov. 10, 1975

[30] Foreign Application Priority Data

Nov. 11, 1974 Japan ..... 49-129699

[51] Int. Cl.[2] ..... A24B 15/00

[52] U.S. Cl. ..... 131/2; 131/17 AC; 131/140 C

[58] Field of Search ..... 131/140 C, 17, 2, 15

[56] References Cited

U.S. PATENT DOCUMENTS

| | | | |
|---|---|---|---|
| T912,011 | 7/1973 | Hapham et al. | 131/2 |
| 2,797,689 | 7/1957 | Frankenburg | 131/140 C X |
| 2,976,873 | 3/1961 | Carmellini et al. | 131/140 C |
| 3,012,562 | 12/1961 | Merritt | 131/140 C |
| 3,404,691 | 10/1968 | Moshy et al. | 131/140 C |
| 3,931,824 | 1/1976 | Miano et al. | 131/2 |

FOREIGN PATENT DOCUMENTS

| | | | |
|---|---|---|---|
| 1,546,092 | 10/1968 | France | 131/17 AC |

OTHER PUBLICATIONS

Tobacco & Tobacco, Smoke by Wynder et al., Academic Press, 1967, N. Y.; pp. 350 & 330.

The Chemistry & Technology of Tobacco by Shmuck, vol. III, pp. 602 & 603, cited, Published by Pishchepromizdut, Moscow, 1953.

*Primary Examiner*—Robert W. Michell
*Assistant Examiner*—V. Millin
*Attorney, Agent, or Firm*—Blanchard, Flynn, Thiel, Boutell & Tanis

[57] ABSTRACT

A smoking composition comprising, as one component, an ester of one or more aliphatic acids and a carbohydrate including cellulose, starch, and the like. The smoking composition is mild and non-irritating, has no off-flavor, and no unpleasant aftertaste remains after smoking.

18 Claims, No Drawings

SMOKING COMPOSITION

BACKGROUND OF THE INVENTION

1. Field of the Invention

This invention relates to a smoking composition which comprises, as one component, an ester of one or more aliphatic acids and a carbohydrate such as cellulose and starch.

More particularly, this invention relates to a smoking composition which comprises an ester of one or more aliphatic acids and a carbohydrate including cellulose and starch, used in place of all or a part of natural tobacco leaves as a principal filler for smoking compositions, and/or as a diluent for modifying aroma and taste, and/or as a water-resistant binder or reinforcement for smoking compositions.

2. Description of the Prior Art

In recent years, it has become generally preferred to use tobaccos that are milder and lighter in aroma and taste. That is, tobaccos possessing low nicotine content and low tar content are increasingly being used in smoking compositions. There have recently been presented some proposals for using new smoking materials in place of natural tobacco: for example, α-cellulose is described in Japanese patent publication No. Showa 45-37,080, oxycellulose is disclosed in Japanese patent publication No. Showa 44-22,480, and pyrolytically degraded carbohydrates are disclosed in British Pat. No. 1,113,979.

However, the first-named material is merely paper made of α-cellulose having a relatively low density and without any chemical modification. Thus, it has the disadvantage that the irritating odor arising from combustion of cellulose cannot be removed.

The oxycellulose described in the second referenced patent is not practical for use as a filler material because the physical strength of the cellulose material is reduced when cellulose is oxidized and it is unsuitable as a filler material for cigarettes.

The third-named material must be degraded pyrolytically to below 90% by weight of the starting carbohydrate, so that this material is expensive. Further, this material has the disadvantage that it gives an appearance of apparent incompatibility as a smoking material because the pyrolytically degraded material has a black color.

SUMMARY OF THE INVENTION

We have discovered a new smoking material which does not have the disadvantages mentioned above and it can be used to replace all or a part of the natural tobacco leaf as the filler for smoking compositions, or as a material of mild organoleptic properties for use in combination with tobacco. We have discovered that an ester having a relatively low degree of substitution which is made of one or more aliphatic acids and a carbohydrate, such as cellulose and starch, when burned, can generate smoke which is of low bitterness and high mildness. Further it can also function as a water-resistant binder or reinforcement for smoking compositions.

The aliphatic acid used to make the ester employed in this invention includes one or more aliphatic monocarboxylic acids having one to 18 carbon atoms. It is especially preferred to use acids of the formula RCOOH, wherein R is alkyl having one to 11 carbon atoms, including acetic acid, propionic acid, butyric acid, and higher aliphatic acids having more than 4 carbon atoms. Acetic acid is preferred from the practical and organoleptic viewpoints. However, the invention is not limited to acetic acid.

The degree of substitution of the ester is not particularly critical, but it is preferred to be in the range of not less than 0.1 to not more than 2.5, preferably not less than 0.5 to not more than 2.0. When the degree of substitution is below 0.1, on smoking, smokers experience an irritant odor like that of burning cellulose and if the value is more than 2.5, smokers experience an aliphatic acid-like odor.

The carbohydrates useful in this invention are preferably polysaccharides, especially cellulose and derivatives thereof, starch and derivatives thereof, dextran, dextran derivatives, pullulan and pullulan derivatives, and natural gum.

Esters of aliphatic acids and carbohydrates having a relatively low degree of substitution can be prepared by conventional methods. A representative method for making the same shall be illustrated below by an example of the preparation of cellulose acetate.

Cellulose, for example, cotton linters pretreated with acetic acid, is treated with a mixed acid of acetic acid and acetic anhydride in the presence of sulfuric acid, as catalyst, to give cellulose triacetate having a degree of substitution of about 2.9 (substituted number of hydroxyl groups per anhydroglucose unit) in the dope form. After the starting free fibrous cellulose material is changed into the uniform dope state of the reaction product, water is added in the required amount into the reaction product to decompose the residual acetic anhydride. Further, simultaneously the sulfuric acid is partially neutralized with a neutralizing agent contained in the water to hydrolyze and ripen the product. After the passage of the required ripening time, the remaining residual sulfuric acid is neutralized with a neutralizing agent to stop the hydrolysis reaction. The resulting dope is poured into a large excess of water with agitation to give solid cellulose acetate having a flake shape. The cellulose acetate is washed with water until the washing water is no longer acidic and then it is dried to give white cellulose acetate flakes.

Cellulose acetate, having a relatively low degree of substitution, can be obtained by the following method. Commercially available cellulose diacetate having a degree of substitution of 2.4 is dissolved in an aqueous acetic acid solution, and a small amount of sulfuric acid is added into the solution to hydrolyze and ripen the acetate. After the prescribed time interval, the sulfuric acid is neutralized with a neutralizing agent to stop the hydrolysis reaction and then the resultant dope is poured with agitation into a large excess of water or an organic solvent, such as methanol, depending on the degree of substitution, thus obtaining cellulose acetate flakes having a low degree of substitution. The cellulose acetate flakes are washed with water or an organic solvent, such as methyl alcohol, until the washing solution is no longer acidic and then are dried to give white cellulose acetate flakes with a low degree of substitution. The cellulose acetate with a low degree of substitution thus obtained, on combustion, generates a much less irritating smoke, which is mild in aroma and taste. Therefore, the cellulose acetate can be used in place of natural tobacco leaf and can be processed by the conventional methods used for natural tobacco leaf to prepare smoking compositions, such as cigarettes. Also, it can be molded by any conventional procedure for use as a filler for smoking compositions and as a diluent for modifying aroma and taste. The cellulose acetate can also be used as a water-resistant binder or reinforcement for tobacco powder as described later.

As a detailed explanation of this invention, there shall be described a method for producing smoking compositions wherein cellulose acetate with low degree of substitution is used as a filler for smoking composition, as a diluent for aroma and taste, as a binding component, and as a reinforcement.

The cellulose acetate having a low degree of substitution is dissolved in an organic solvent such as acetone or an aqueous solution of an organic solvent such as aqueous acetone solution and is formulated as a uniform dope of 5 to 15 wt.% concentration. Into this dope, there is added finely ground tobacco powder in the ratio of 0 to 4, especially 1 to 4, parts of tobacco powder per one part of the cellulose acetate. If required, a humectant, an ash-forming agent, a combustion assistant and other conventional ingredients are added. The mixture of these agents is stirred until a uniform slurry is formed. The resulting tobacco slurry is cast in the form of a thin film and the solvent is then evaporated to give a sheet-form smoking composition, which is moisture-conditioned so as to have a water content of 12 to 14 wt.%. The resulting sheet-form smoking composition is very homogeneous, and it is found that when it is burned, the generated smoke is not irritating and the smoking composition possesses excellent physical properties such as strength, elongation, and water-resistance.

The organic solvent evaporated from the cast slurry in thin film shape can be easily recovered by the usual methods, and it can be used repeatedly as the solvent for cellulose acetate of low acetyl content.

The sheet-form smoking composition (a) obtained by the slurry process in this invention was compared with another sheet-form smoking composition (b) made using wood pulp, as a filler, as a diluent for aroma and taste, and a reinforcement, and using sodium salt of carboxymethyl cellulose as a binder. The physical properties of the foregoing two types of smoking compositions (a) and (b) were compared after the compositions (a) and (b) had been cut and made into two types of cigarette smoking compositions. These were evaluated as to organoleptic properties by fifty habitual smokers. The results are summarized in Table 1.

Note:

1. Cellulose acetate with a degree of substitution of 1.76 was used.

2. The wood pulp employed was a needle-leaf pulp having 91 wt.% of α-cellulose content.

3. The water resistance test was performed by placing the sample into water at 25° C, shaking the sample occasionally and then determining the time till the sheet sample became macerated. The time represents the water resistance.

4. The organoleptic properties were evaluated by 50 habitual smokers.

As shown in Table 1, the sheet-form tobacco comprising cellulose acetate of low acetyl content made by the slurry process in this invention is highly excellent in physical properties, such as strength, elongation, and water resistance, as well as for use as a diluent for modifying aroma and taste.

In the method for making a smoking composition using the cellulose acetate having low degree of substitution as a filler and as a diluent for aroma and taste, a powder of cellulose acetate with low acetyl content is incorporated into finely ground tobacco powder in an amount of from 10 to 50% by weight of said cellulose acetate, based on the total weight of the smoking composition, the sodium salt of carboxymethyl cellulose (Na—CMC) is dissolved in water and the Na—CMC solution is added into the smoking composition in an amount of 1 to 3% based on the weight of the smoking composition (bone dry basis), and the resulting mixture is kneaded in a kneader and milled with a roller, and dried, thus obtaining a sheet-form smoking composition.

The smoking composition was cut into fibers and made into cigarettes which were moisture-conditioned so as to have a water content of 12 to 14 wt.%. It was then tested for organoleptic properties by fifty habitual smokers. For comparison, wood pulp containing not less than 90% of α-cellulose was incorporated in place of the foregoing cellulose acetate and was made into a sheet-form smoking composition which was made into cigarettes in like fashion.

The foregoing two types of cigarettes were tested for organoleptic properties. The results are summarized in Table 2.

Table 1

| | | Comparison of two types of sheet-forming smoking compositions in physical and organoleptic properties | |
|---|---|---|---|
| | | sheet-form smoking composition obtained by the process in this invention | sheet-form smoking composition containing wood pulp obtained by the roll process |
| composition | tobacco powder | 100 parts | 100 parts |
| | cellulose acetate | 30 parts | none |
| | wood pulp | none | 30 parts |
| | glycerine | 3 parts | none |
| | sodium salt of carboxymethyl cellulose | none | 3 parts |
| | glyoxal | none | 2 parts |
| physical properties | thickness (mm) | 0.13 | 0.15 |
| | tensile strength ($g/mm^2$) | 227 | 150 |
| | elongation (%) | 1.5 | 1.0 |
| | water resistance (hrs.) | not less than 48 | 0.5 |
| | evaluation of organoleptic properties | No irritation and no off-flavor. Mild and light. No unpleasant aftertaste remains | Irritation. Slight odor felt of scorching paper. Slight unpleasant aftertaste remains. |

Table 2

| Relation between amount of cellulose acetate with low degree of substitution, or wood pulp, and the organoleptic properties of the resulting smoking compositions | | |
|---|---|---|
| amount of cellulose acetate or wood pulp (percent by weight) | sheet-form smoking compositions containing cellulose acetate of low acetyl content | sheet-form smoking compositions containing wood pulp |
| 10% | No irritation and no off-flavor. Mild and light. No unpleasant aftertaste remains. | Slight irritant, but mild and light. No unpleasant aftertaste remains. |
| 20% | No irritation and no off-flavor. Mild and light. No unpleasant aftertaste remains. | Slight paper-scorching odor. Slight unpleasant aftertaste remains. |
| 30% | No irritation and no off-flavor. Mild and very light. No unpleasant aftertaste remains. | Strong irritation and strong paper-scorching odor. Unpleasant aftertaste remains. |
| 50% | No irritation and no off-flavor. Mild and light. No unpleasant aftertaste remains. | Throat irritation occurred. Sharp taste. Strong paper-scorching odor. Unpleasant aftertaste remains. |

Note:

1. The cellulose acetate used had a degree of substitution of 1.76.

2. The wood pulp used was a needle-leaf pulp containing 91 wt.% of $\alpha$-cellulose.

As indicated in Table 2, the cigarette smoking compositions made from sheet-form smoking compositions containing cellulose acetate of low acetyl content are less irritating, milder, and much more light in organoleptic properties than those containing wood pulp, and no unpleasant aftertaste remained.

Therefore, cellulose acetate with a low degree of substitution is advantageous as a filler for tobacco, as a reinforcement, and as a diluent for aroma and taste. The methods for obtaining sheet-form smoking compositions as previously described are not limited to the slurry process and the rolling process, but also include any processes known in the prior art such as the paper-making process.

It is also possible to provide a new artificial synthetic tobacco for smoking which essentially consists of an aliphatic acid ester of a carbohydrate made by the method in this invention without using any natural tobacco leaf. To the ester there can be added various conventional prior art additives, for example, flavor additives, burning assistants, ash modifiers, humectants, and nicotine; and then the resulting mixture can be sheeted into a synthetic smoking composition.

The smoking composition of this invention, further, can be cut into shredded smoking compositions and cigar smoking compositions as well as cigarette smoking compositions, and it can be used as a cigar wrapper because it is in a sheet form.

We shall illustrate the effect of this invention by the following Examples.

EXAMPLE 1

Five hundred grams of purified linters were charged into a pretreating vessel of 15 liters volume and were sprayed with 500 g of glacial acetic acid and then were maintained at 40° C for 2 hours. Then a mixed acid comprised of 1,875 g of acetic anhydride, 4,375 g of glacial acetic acid, and 75 g of sulfuric acid was charged into a kneader of 10 liters volume and was cooled to 5° C. The entirety of the foregoing pretreated linters was charged with agitation into the kneader and then was acetylated for 2 hours and 30 minutes while controlling the temperature of the contents of the kneader so that the temperature rose to 36° C in 30 minutes and then the temperature was gradually reduced to 26° C at the completion of the reaction, so that a uniform dope was formed. Thereafter, a 30% acetic acid solution in water, containing dissolved therein an amount of sodium acetate sufficient for neutralizing 50 g of the sulfuric acid in the dope, was added to the dope to reduce the acetic acid concentration in the dope to 80 wt.%, then the temperature of the resulting solution was raised to 80° C in 15 minutes, and the solution was kept at 80° C for 2 hours to hydrolyze and ripen the reaction solution. The acetic acid concentration in the dope is represented by (the weight of the acetic acid in the dope $\times 100$) $\div$ (the weight of the acetic acid in the dope + the weight of the water in the dope)). Thereafter, a 30% acetic acid solution in water, containing dissolved therein an amount of sodium acetate sufficient for neutralizing the remaining 25 g of sulfuric acid, was added to the dope to stop the hydrolysis and ripening reactions. The resulting dope was poured with vigorous agitation into a precipitator containing 30 l of water to precipitate cellulose acetate flakes. The flakes were washed with running water until the washing liquid became neutral, and then was dehydrated and dried at 50° C in vacuum to obtain white cellulose acetate flakes. The degree of substitution thereof was 1.77 by analysis, based on the acetic acid combined with the linters.

Thirty grams of the foregoing cellulose acetate were dissolved in 270 g of 90% acetone in water to give a uniform dope. Into the dope were added 100 g of tobacco powder of not more than 40 mesh (Japanese Industrial Standard) and 3 g of glycerine. The mixture was stirred for 30 minutes and then was cast on a glass plate with an applicator of the type used for thin layer chromatography. The acetone in the mixture was evaporated at room temperature and the resulting film was delaminated from the glass plate to give a sheet-form smoking composition. The sheet-form smoking composition was moisture-conditioned to 13 wt.% water content in a conditioning room. The sheet-form smoking composition had a tensile strength of 227 g/mm$^2$ and it was not macerated and remained in sheet form after immersion in water for 48 hours.

The sheet-form smoking composition was cut into pieces of 1 mm in width which were made into cigarettes. The cigarettes were evaluated for smoking aroma and taste by 50 habitual smokers. All of them stated that the cigarettes, when smoked, were very mild, were free of irritation, and gave no unpleasant aftertaste.

EXAMPLE 2

Commercially available cellulose diacetate having a degree of substitution of 2.44 (150 g) was dissolved in 900 g of 60% acetic acid solution in water in a flask of 2 liters volume to obtain a uniform dope. Into the dope was added 15 g of sulfuric acid, and the mixture heated to 80° C in 15 minutes, and then hydrolyzed and ripened at 80° C for 2 hours.

Then the dope was poured with vigorous agitation into a mixer containing 1 liter of methyl alcohol to give cellulose acetate flakes, which were washed with water until the washing liquid became neutral, and then dried at 50° C under vacuum to obtain white cellulose acetate flakes. The degree of substitution was 1.26 from the analytical value of the acetic acid combined with the cellulose.

Thirty grams of the foregoing cellulose acetate flakes was dissolved in 270 g of 70% acetone solution in water to form a dope. Into the dope were added 100 g of tobacco powder as described in Example 1 and 3 g of glycerine, the suspension was mixed with agitation for 30 minutes, the suspension was cast on a glass plate with an applicator, and then the acetone in the dope was evaporated to give a sheet-form smoking composition. The sheet-form smoking composition was moisture-conditioned to 13 wt.% water content in a conditioning room. The sheet-form smoking composition had a tensile strength of 200 g/mm$^2$. When it was immersed in water for 48 hours, it did not change in shape. The sheet-form tobacco composition was cut into pieces of about 1 mm in width and was made into cigarettes which were tested for aroma and taste by fifty habitual smokers. All of the smokers judged that the cigarette tobacco was very mild and non-irritating and, further, no unpleasant aftertaste remained after smoking.

EXAMPLE 3

Thirty grams of cellulose acetate as described in Example 1 was dissolved in 270 g of 90% acetone solution in water to make a uniform dope. Into the dope were added 30 g of tobacco powder as mentioned in Example 1 and 1.2. g of glycerine, and the dispersion was mixed with agitation for 30 minutes. The mixture was cast on a glass plate with an applicator and then the acetone in the mixture was evaporated at room temperature to give a sheet-form smoking composition. The sheet-form smoking composition had a tensile strength of 880 g/mm$^2$ after it was moisture-conditioned to 13 wt.% water content in a conditioning room and it did not at all change in shape when immersed in water for 48 hours. The sheet-form smoking composition was cut into pieces of about 1 mm in width and was made into cigarettes which were tested in terms of their organoleptic properties by fifty habitual smokers. All of them stated that the smoking composition was very mild and non-irritating when smoked and that no unpleasant aftertaste remained.

EXAMPLE 4

Thirty grams of the cellulose acetate mentioned in Example 2 was dissolved in 270 g of 70% acetone in water to give a uniform dope. Into the dope were added 30 g of tobacco powder as described in Example 1 and 1.2 g of glycerine, and the mixture was blended with agitation for 30 minutes. The mixture was cast onto a glass plate with an applicator and the acetone therein was evaporated at room temperature to give a sheet-form smoking composition.

The sheet-form smoking composition had a tensile strength of 845 g/mm$^2$ after being moisture-conditioned in a conditioning room to 13 wt.% water content and it did not change shape at all when immersed in water for 48 hours. The sheet-form smoking composition was cut into pieces of 1 mm in width and was made into cigarettes which were tested for organoleptic properties by fifty habitual smokers. All of them stated that the cigarettes were very mild and non-irritating when smoked and that no unpleasant aftertaste remained.

EXAMPLE 5

To 100 g of tobacco powder as described in Example 1 were added 25 g of the cellulose acetate powder mentioned in Example 1 and they were uniformly blended in a kneader of one liter volume. Thereafter, into the mixture was added a solution of 3 g of sodium salt of carboxymethyl cellulose dissolved in 100 cc of water and the mixture was kneaded for 30 minutes at room temperature. The kneaded material was made into a sheet by biaxial rolling and dried, so that there was obtained a sheet-form smoking composition of 0.15 mm thickness. The sheet-form smoking composition was cut into pieces of about one mm in width and was made into cigarettes, which was moisture-conditioned to 13 wt.% water content. For comparison with the above smoking composition, a sheet-form smoking composition was made by the same procedure, replacing the foregoing cellulose acetate with an equal amount of wood pulp. This sheet-form smoking composition was cut into a cigarette filler smoking composition as described above. The cigarette filler smoking compositions were tested for organoleptic properties by fifty habitual smokers who stated that the smoking composition according to this invention was non-irritating and had no off-flavor, and no unpleasant aftertaste remained after smoking, whereas the comparison smoking composition had a slight paper-scorching odor and slight unpleasant aftertaste after smoking.

EXAMPLE 6

To 100 g of tobacco powder as described in Example 1 was added 50 g of the cellulose acetate powder described in Example 2 and the mixture was uniformly blended in a kneader of one liter volume. Thereafter into this kneader was added a solution of 3 g of sodium salt of carboxymethyl cellulose dissolved in 100 cc of water and this mixture was kneaded at room temperature for 30 minutes. Thereafter, a cigarette filler smoking composition was made in the same manner as described in Example 5. For comparison, a sheet-form smoking composition was made in the same fashion, except that the cellulose acetate was replaced by an equal amount of wood pulp to give a comparison cigarette filler composition. The compositions were tested for organoleptic properties by fifty habitual smokers. All of them stated that the smoking composition according to this invention had no irritation and no off-flavor and were mild, and further that no unpleasant aftertaste remained after smoking, whereas the comparison smoking composition had a strong paper-scorching odor and an unpleasant aftertaste remained after smoking.

EXAMPLE 7

Cellulose diacetate having a degree of substitution of 2.44 was subjected to the hydrolysis and ripening reactions under the same conditions as described in Example 2 for 6 hours. Then the resulting dope was neutralized with sodium acetate and was poured with agitation into a mixer containing isopropyl alcohol to precipitate cellulose acetate in powder form. The powdery cellulose acetate was washed with isopropyl alcohol until the washing liquid became neutral, the liquid was removed, and the powder was dried under vacuum at 30° C, thus obtaining a white powder of cellulose acetate. From the results of analytical value of combined acetic acid, the degree of substitution was 0.36.

To 100 g of tobacco powder as mentioned in Example 1 there was added 100 g of the cellulose acetate powder described above and they were uniformly blended in a kneader having a volume of one liter. Then into this kneader was added a solution of 3 g of sodium salt of carboxymethyl cellulose dissolved in 100 cc of water and the mixture was kneaded at room temperature for 30 minutes. Thereafter, a cigarette filler smoking composition was made in the same manner as described in Example 5. For comparison a sheet-form smoking composition was produced in like fashion, except that the cellulose acetate was replaced by an equal amount of wood pulp and this was made into a cigarette filler smoking composition.

The cigarette smoking compositions were tested for organoleptic properties by fifty habitual smokers who evaluated the compositions as follows: according to the impressions of all of the smokers, the cigarette smoking composition according to this invention was mild, had no irritation and no off-flavor, and no unpleasant aftertaste remained after smoking, whereas the comparison smoking composition had a bitter and irritating taste and a paper-scorching odor, and further an unpleasant aftertaste remained.

EXAMPLE 8

Cigarette filler smoking compositions were made by the same method as described in Example 7 except that cellulose acetate with a degree of substitution of 1.77 was used instead of the cellulose acetate having a degree of substitution of 0.36. The smoking compositions were tested for organoleptic properties by fifty habitual smokers. All of the smokers stated that the smoking compositions, when smoked, were mild, had no irritation and no off-flavor, and no unpleasant aftertaste remained.

EXAMPLE 9

Cigarette smoking compositions were made by the same method as described in Example 5 except that a cellulose acetate having a degree of substitution of 2.44 was used in place of the cellulose acetate with a substitution degree of 1.77 and were tested for organoleptic properties by fifty habitual smokers. All of the smokers stated that the smoking compositions, when smoked, were mild, had no irritation and no off-flavor. However, five persons of the test group stated that the smoking composition had a slight odor of acetic acid.

EXAMPLE 10

A portion of the dope obtained by hydrolyzing, ripening and neutralizing the cellulose acetate, as described in Example 7, was cast onto a glass plate with an applicator. The cast material and the glass plate was immersed into a bath of isopropyl alcohol to coagulate the cast film, thus obtaining a cellulose acetate sheet. The sheet was washed with isopropyl alcohol repeatedly until the washing liquid became neutral, and then dried under vacuum at 30° C. The resulting cellulose acetate has a degree of substitution of 0.36, the same as in Example 7.

Then the sheet was cut into pieces of about one mm in width and was made into cigarettes, which were tested for organoleptic properties by fifty habitual smokers. All of the smokers stated that the substance was not irritating and was mild when smoked.

EXAMPLE 11

Thirty grams of cellulose acetate having a substitution degree of 1.77, as described in Example 1, was dissolved in 270 g of 90% acetone solution in water to give a uniform dope. To the dope was added 3 g of finely divided particles of potassium nitrate as a burning assistant and this was uniformly dispersed in the dope with agitation.

The resulting suspension was cast onto a glass sheet with an applicator and the acetone in the solution was evaporated to give a film. The film was delaminated from the glass plate, thus obtaining a cellulose acetate sheet.

Then the sheet was cut into pieces of about one mm in width and was made into cigarettes. The cigarettes were tested for organoleptic properties by fifty habitual smokers. All of the smokers stated that the substance was not irritating and was mild when smoked.

EXAMPLE 12

A cellulose acetate sheet was made by the same method as described in Example 11, except that magnesium formate was used in place of potassium nitrate, as a burning assistant. The sheet was made into cigarettes, which were tested for organoleptic properties by fifty habitual smokers. All of the smokers stated that the substance was not irritating and was mild when smoked.

The embodiments of the invention in which an exclusive property or privilege is claimed are defined as follows:

1. A smoking product consisting essentially of a homogeneous mixture of cellulose acetate having a degree of substitution of from 0.5 to 2.0, and from one to 4 parts by weight of tobacco, per one part by weight of said cellulose acetate.

2. A smoking product according to claim 1, consisting essentially of fibers containing from 12 to 14 weight percent water, said cellulose acetate and natural tobacco powder, obtained by casting a slurry consisting essentially of a dope of said cellulose acetate in an organic solvent therefor having dispersed therein said tobacco powder to form a film, removing the solvent, shredding the film to fiber form and then moisture conditioning the fibers.

3. A smoking product as claimed in claim 1 prepared by blending finely divided tobacco in a dope containing from 5 to 15 weight percent of said cellulose acetate dissolved in a solvent selected from the group consisting of acetone and aqueous acetone solution, whereby to form a slurry; forming a film of said slurry; and then evaporating said solvent from said film.

4. A smoking product as claimed in claim 2 in which said cellulose acetate having a degree of substitution of from 0.5 to 2.0 has been prepared by hydrolyzing a starting cellulose acetate having a higher degree of substitution.

5. A cigarette containing, as the burnable filler thereof, the smoking product of claim 1.

6. A smoking product consisting essentially of a homogeneous mixture of particles of cellulose acetate having a degree of substitution of from 0.5 to 2.0 and particles of tobacco, said particles being bound together by sodium carboxymethyl cellulose, said product containing from 10 to 50 weight percent of said cellulose acetate, from one to 3 weight percent of said sodium carboxymethyl cellulose and the balance consists essentially of tobacco.

7. A smoking product according to claim 6, consisting essentially of fibers containing from 12 to 14 weight percent water, said cellulose acetate and natural tobacco powder, obtained by mixing a powder of said cellulose acetate, said tobacco powder and an aqueous solution of sodium carboxymethyl cellulose, forming the mixture into a sheet, shredding the sheet into fibers and then moisture conditioning the fibers.

8. A smoking product as claimed in claim 6 prepared by blending particles of said cellulose acetate and particles of tobacco in an aqueous solution of sodium carboxymethyl cellulose; forming a sheet of the blend and then evaporating water from the sheet.

9. A smoking product as claimed in claim 6 in which said cellulose acetate having a degree of substitution of from 0.5 to 2.0 has been prepared by hydrolyzing a starting cellulose acetate having a higher degree of substitution.

10. A cigarette containing, as the burnable filler thereof, the smoking product of claim 6.

11. A smoking product consisting essentially of cellulose acetate having a degree of substitution of from 0.5 to 2.0 and having blended therein at least one additive substance selected from the group consisting of flavor additives, burning assistants, ash modifiers, humectants and nicotine.

12. A smoking product as claimed in claim 11 prepared by blending a burning assistant selected from the group consisting of potassium nitrate and magnesium formate in a dope of said cellulose acetate dissolved in a solvent for said cellulose acetate, forming the blend into a sheet and then evaporating the solvent from the sheet.

13. A smoking product as claimed in claim 11 in which said cellulose acetate having a degree of substitution of from 0.5 to 2.0 has been prepared by hydrolyzing a starting cellulose acetate having a higher degree of substitution.

14. A cigarette containing, as the burnable filler thereof, the smoking product of claim 11.

15. A cigarette containing, as the burnable filler thereof, a blend of tobacco with the smoking product of claim 11.

16. A process of manufacturing a smoking product which consists essentially of blending finely divided tobacco in a dope containing from 5 to 15 weight percent of cellulose acetate having a degree of substitution of from 0.5 to 2.0 dissolved in a solvent selected from the group consisting of acetone and an aqueous acetone solution, whereby to form a slurry, forming a film of said slurry and then evaporating said solvent from the film.

17. A process of manufacturing a smoking product which consists essentially of blending particles of cellulose acetate having a degree of substitution of from 0.5 to 2.0, tobacco particles and an aqueous solution of sodium carboxymethyl cellulose; forming a sheet of the blend and then evaporating the water from the sheet.

18. A process of manufacturing a smoking product which consists essentially of blending a burning assistant selected from the group consisting of potassium nitrate and magnesium formate in a dope of cellulose acetate having a degree of substitution of from 0.5 to 2.0 dissolved in a solvent for said cellulose acetate, forming the blend into a sheet and then evaporating the solvent from the sheet.

* * * * *

UNITED STATES PATENT AND TRADEMARK OFFICE

CERTIFICATE OF CORRECTION

PATENT NO. : 4 068 670

DATED : January 17, 1978

INVENTOR(S) : Hiromu Yokota et al

It is certified that error appears in the above-identified patent and that said Letters Patent are hereby corrected as shown below:

Column 10, line 66; change "2" to ---3---.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*